United States Patent [19]

Dayton

[11] 4,339,166

[45] Jul. 13, 1982

[54] CONNECTOR

[76] Inventor: John P. Dayton, 10707 Camarillo, Apt. 105, Toluca Lake, Calif. 91602

[21] Appl. No.: 161,039

[22] Filed: Jun. 19, 1980

[51] Int. Cl.[3] ..... H01R 4/24

[52] U.S. Cl. ..... 339/100; 339/177 E

[58] Field of Search ..... 339/100, 177 E; 174/21 C, 21 JC, 21 CA

[56] References Cited

U.S. PATENT DOCUMENTS

| | | | |
|---|---|---|---|
| 2,711,520 | 6/1955 | Kernen et al. | 339/100 |
| 3,517,112 | 6/1970 | Wahl | 339/100 |
| 3,646,502 | 2/1972 | Hutter et al. | 339/177 E |
| 4,284,321 | 8/1981 | Detemple et al. | 339/177 E |

*Primary Examiner*—John McQuade

*Attorney, Agent, or Firm*—Keith D. Beecher

[57] ABSTRACT

A push-on connector for use in conjunction with television sets and video equipment for connecting a 75 ohm coaxial shielded cable, or the like, to the equipment. The coaxial shielded cable is of the type having an inner conductor surrounded by an inner dielectric sleeve which, in turn, is surrounded by a tubular braided conductor, the tubular braided conductor being surrounded by an outer dielectric sleeve. The connector of the invention is equipped with barbed components which establish independent electrical contacts with the outer tubular braided conductor shield of the cable and a central tubular pin which establishes contact with the inner conductor, this being achieved merely by pushing the end of the cable into the connector. The connector itself is received in a plug in the video equipment by pushing the connector into the plug.

4 Claims, 4 Drawing Figures

CONNECTOR

BACKGROUND

The usual prior art connector which is used for connecting 75 ohm coaxial cable, and the like, to video equipment, requires that the end of the coaxial cable be stripped by an appropriate tool to uncover a length of the central conductor. The end of the coaxial cable is then inserted into the prior art connector to extend coaxially into the housing of the connector. The end of the braided conductor shield is turned back over the outer dielectric sleeve to make contact with the housing of the connector, and the prior art connector is then crimped to the cable by means of a special crimping ring. The end of the central conductor extends axially beyond the end of the housing to be received in an appropriate socket in the video equipment.

The usual prior art connector, as described above, requires special tools and special skills before it can be attached to the coaxial cable. In addition, specific instructions are necessary as to the manner in which the connector is to be connected to the cable.

The prior art connector is a two-piece assembly, since it requires the crimping ring to secure it to the cable. It is usually screwed into the socket provided in the video equipment. The metal exterior of the prior art connector is susceptible to short circuits with adjacent metal objects.

The connector of the present invention, on the other hand, is a one-piece unit insofar as the installer is concerned, and it does not require any tools or any special skills. No stripping of the coaxial cable is required. Instead, the end of the coaxial cable is merely pushed into the connector and it is held securely in the connector by barbed elements of the connector, as will be described, so that no crimping ring is required. The connector of the invention, preferably, has a plastic exterior surface, and has no tendency to short circuit to adjacent metal parts. The connector itself is received in a receptacle of the video equipment by a simple push-in operation.

Accordingly, an object of the present invention is to provide a coaxial cable connector which is simple and inexpensive to produce, and which is easy to use and does not require any special tools or any special skills.

DETAILED DESCRIPTION OF THE ILLUSTRATED EMBODIMENT

Figure 1:
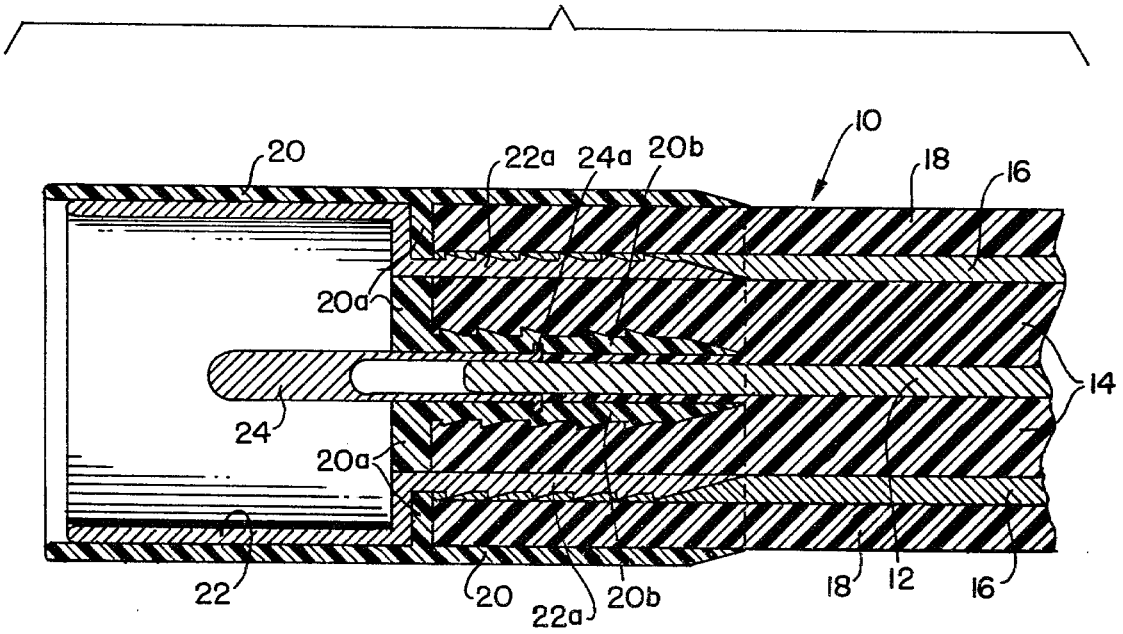
FIG. 1 is a sectional representation of a connector constructed in accordance with one embodiment of the present invention, and illustrating the manner in which a coaxial cable is inserted into and firmly held by the connector.

The connector of the present invention, as shown in FIG. 1, receives the end of a coaxial cable 10. Coaxial cable 10, as described above, is one which includes a central solid conductor 12 which is surrounded by an inner dielectric sleeve 14. The dielectric sleeve 14, in turn, is surrounded by a tubular braided conductor 16, the tubular braided conductor 16 being surrounded by an outer dielectric sleeve 18.

Figure 2:
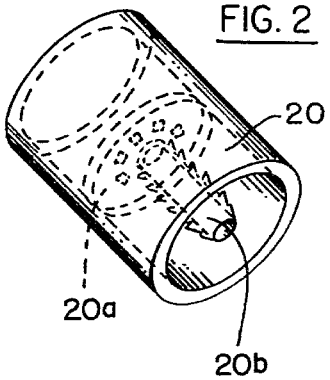
FIG. 2 is a perspective representation of the housing of the connector of FIG. 1, on a reduced scale with respect to the view of FIG. 1.

The connector of the invention includes an outer housing 20 which is formed of any appropriate plastic material. The housing 20, as also shown in FIG. 2, includes an integral intermediate disc-like portion 20A, and the housing, which has a tubular configuration, is open at both ends. The disc-like portion 20A has a central tubular portion 20B formed integral with it, the tubular portion 20B extending coaxially with the housing 20. The tubular portion 20B has a multiplicity of barbs formed on its outer surface.

Figure 3:
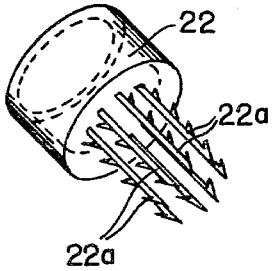
FIG. 3 is a perspective view of a metallic insert which is coaxially mounted within the housing of FIG. 2, likewise on a reduced scale with respect to the representation of FIG. 1.
Figure 4:
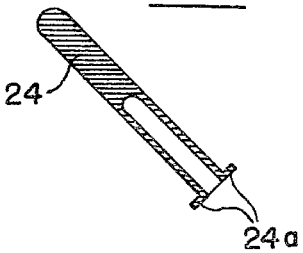
FIG. 4 is a perspective representation of a central connector pin which is supported in the housing of FIG. 2.

The connector also includes a metal insert 22. The metal insert 22, as also shown in FIG. 3, includes a plurality of prongs 22A which, likewise, are barbed. Prongs **22*a* are mounted at spaced annular positions around a circular path coaxial with the longitudinal axis of the connector, as shown in FIG. 3. The prongs 22*a* are received in corresponding holes in the disc-like partition 20*a* (shown in FIG. 2) when the insert 22 is positioned in the housing 20, as shown in FIG. 1. The insert 22 has the configuration shown in FIGS. 1 and 3**, and it is formed of a conductive metal.

The connector also includes a central pin 24 formed of a conductive resilient metal, such as beryllium copper. The pin 24 is hollow at one end, and is configured to extend through a central hole in the disc-like portion **20*a* of housing 20 and into the interior of tubular portion 20B. The pin has an end flange 24A which is received in an annular slot in the tubular portion 20B (FIG. 1) so that the pin 24** may be firmly retained within the assembly.

In order to mount the connector on the end of the cable 10, it is merely necessary to push the end of the cable into the right-hand end of housing 20, until the end of the cable is flush with the disc-like portion 20A.

When the cable is inserted into the end of housing 20 to the position shown in FIG. 1, the barbed tubular member 20B extends between the central conductor 12 and the inner dielectric sleeve 14 to form a secure anchor to hold the coaxial cable 10 securely within the housing 20 of the connector.

The end of the central conductor 12 is now received in the hollow portion of the central pin 24, and the hollow end of the pin is pressed against the central conductor by the tubular portion 20B, as shown in FIG. 1. Therefore, the pin 24 is established in firm and good electric contact with the central conductor 12.

The barbed prongs 22A now extend between the inner dielectric sleeve 14 and the tubular braided conductor 16 as also shown in FIG. 1, so that the metallic insert 22 is established in firm and good electric contact with the braided conductor.

The connector of the invention may be received in an appropriate socket in the video equipment, merely by pushing the left-hand end of the connector into the socket so that independent electric connection is established by mating components in the socket between the insert 22 and the center pin 24, which are respectively connected to the braided conductor 16 and the center conductor 12 of the coaxial cable.

It will be appreciated that the connector of the invention is simple to operate, since it may be connected and fastened to the end of the coaxial cable 10, merely by pushing the end of the coaxial cable into the open end of housing 20, without any need to strip the coaxial cable, thus obviating any requirement for special skills or tools.

It will also be appreciated that although a particular embodiment of the invention has been shown and described, modifications may be made. It is intended in the claims to cover all modifications which come within the spirit and scope of the invention.

What is claimed is:

1. A connector for mounting on the end of a coaxial shielded cable of the type having a central conductor surrounded by an inner dielectric sleeve which, in turn, is surrounded by a tubular braided conductor, the tubular braided conductor being surrounded by an outer dielectric sleeve, said connector comprising: a tubular housing formed of insulating material, said housing being open at each end and having an inner diameter corresponding to the outer diameter of the coaxial cable for receiving the coaxial cable through one end of said housing, said tubular housing having an intermediate partition therein against which the end of the coaxial cable abuts, and said partition having a central tubular portion extending coaxially towards said one end of the tubular housing and having an inner diameter corresponding to the outer diameter of the central conductor of the cable and in a position to extend between the inner surface of said inner dielectric sleeve and the outer surface of said central conductor to receive the end of the central conductor, said tubular portion having a plurality of external barbs thereon for engaging the inner surface of said inner dielectric sleeve; an electrically conductive insert mounted in said housing and having at least one prong extending through said partition toward said one end of said housing in position to extend between said tubular braided conductor and said inner dielectric sleeve to engage and establish electrical contact with said braided conductor; and an electrically conductive pin mounted in said central partition and extending coaxially within said housing toward the other open end thereof, and said pin also extending into said tubular portion toward said one end of said housing, and having a hollow end portion at said one end of said housing to receive the end of said central conductor so as to establish electrical contact between said pin and said central conductor.

2. The connector defined in claim 1, in which said prong, likewise, has a plurality of barbs formed thereon.

3. The connector defined in claim 1, in which said insert has a tubular configuration and is mounted coaxially in said other open end of said tubular housing, with said prong extending through an aperture in said partition.

4. The connector defined in claim 1, in which said insert has a plurality of prongs positioned in a circular path coaxial with the longitudinal axis of said connector and extending axially towards said one end.

* * * * *